US005996245A

United States Patent [19]

Yamato

[11] Patent Number: 5,996,245

[45] Date of Patent: Dec. 7, 1999

[54] AERATION-TYPE ROTARY DRYER

[75] Inventor: Yukio Yamato, Tokyo, Japan

[73] Assignee: Yamato Sanko MEG. Co., Ltd., Tokyo, Japan

[21] Appl. No.: 08/973,112

[22] PCT Filed: Apr. 8, 1996

[86] PCT No.: PCT/JP96/00958

§ 371 Date: Dec. 3, 1997

§ 102(e) Date: Dec. 3, 1997

[87] PCT Pub. No.: WO97/38277

PCT Pub. Date: Oct. 16, 1997

[51] Int. Cl.[6] ..... F26B 11/02

[52] U.S. Cl. ..... 34/138; 34/134; 34/135

[58] Field of Search ..... 34/134, 135, 136, 34/138, 139, 140, 141, 142; 432/113, 117

[56] References Cited

U.S. PATENT DOCUMENTS

| | | | |
|---|---|---|---|
| 3,742,613 | 7/1973 | Von Gimborn | 34/138 |
| 3,968,572 | 7/1976 | Stuchberry | 34/138 |
| 3,984,920 | 10/1976 | Raymond et al. | 34/138 |
| 4,656,759 | 4/1987 | Yamato | 34/134 |

FOREIGN PATENT DOCUMENTS

| | | |
|---|---|---|
| 45-16294 | 7/1970 | Japan . |
| 59-72493 | 5/1984 | Japan . |
| 59-91590 | 6/1984 | Japan . |
| 61-17885 | 1/1986 | Japan . |
| 5-99568 | 4/1991 | Japan . |

*Primary Examiner*—Henry Bennett
*Assistant Examiner*—Pamela A. Wilson
*Attorney, Agent, or Firm*—Birch, Stewart, Kolasch & Birch, LLP

[57] ABSTRACT

An aeration-type rotary dryer injects air into or onto a flow of materials a rotating cylinder. The air is supplied to an air duct (21) axially passing through the cylinder (10) from the outlet box (11) to the inlet box (12). The axial duct (21) is composed of a plurality of longitudinally, successively connected tubular members (22, 23, 24) each nearer to the inlet box being smaller in diameter than other. The most inlet-sided member (24), located in a central opening (32) of an inlet partition (31) of the cylinder, has the smallest diameter, so that the inlet partition has the central opening reduced and its threshold height increased. This results that the materials are prevented from returning to the inlet box out of the cylinder. The most outlet-sided member (22), located in a central opening (34) of an outlet partition (33) of the cylinder, has the largest diameter, so that a void space in the central opening (34) may be too small to exhaust air. There is a remedy that air exhausts through the outlet partition (33) composed of a plurality of louvers (35) which are disposed at regular intervals on the inner periphery of the cylinder. This allows the dryer to double an amount of exhaust air as well as a drying capacity as compared with the conventional non-aeration type rotary dryer having the same size cylinder.

9 Claims, 7 Drawing Sheets

AERATION-TYPE ROTARY DRYER

This application claims the benefit under 35 U.S.C. §371 of prior PCT International Application No. PCT/JP 96/00958 which has an International filing date of Apr. 8, 1996 which designated the United States of America, the entire contents of which are hereby incorporated by reference.

TECHNICAL FIELD

The present invention relates to an improved rotary dryer of the aeration or through-air type having a shell or rotary cylinder, an air duct axially extending in the cylinder, a plurality of radial pipes branched from the duct to blow hot air from outer ends of the pipes into or onto a flow of materials in the cylinder, whereby the hot air is efficiently contacted with the materials.

BACKGROUND ART

The prior art aeration-type rotary dryer is known by U.S. Pat. No. 4,656,759. The dryer has inlet and outlet boxes, a rotary cylinder having opposite open end portions rotatably and air-tightly fitted in the inlet and outlet boxes, a means for rotating the cylinder, a feeder provided in the inlet box, an air duct having a uniform diameter and axially extending in the cylinder, a hot-air source supplying the axial duct with the hot air, a plurality of radial pipes branched from the duct, an exhaust and a discharge port each provided in the outlet box. The rotary cylinder is provided at its opposite ends with inlet and outlet partitions in the form of a hollow circular plate. The inlet partition is formed with a central opening through which pass the chute of the feeder and the air duct. The outlet partition is also formed with a central opening through which the used air and the treated materials are discharged to the outlet box.

The moist materials form a flow when fed into the cylinder. The flow would overflow to the inlet box if its depth is larger than the radial width or threshold height of the inlet partition. This means that the dryer is sometimes limited in capacity by the radial width of the inlet partition. The conventional aeration-type dryer requires the inlet partition thereof to have a relatively large central opening to receive the chute of the feeder and the air duct of a relatively large diameter, so that the inlet partition inevitably has a relatively small radial width or relatively low threshold. Therefore, it is limited to enlarge the radial width of the inlet partition in order to increase the feeding speed.

The materials, when treated, leave the cylinder to the outlet box through the central opening in the outlet partition threshold plate. The used air also exhausts from the same opening. The dryer can not have a larger capacity without increasing an amount of the exhaust air that is defined by an effective area of the opening in the outlet threshold. If the opening were diametrically enlarged to increase the amount of an exhaust air, the radial width or height of the threshold would become too low to keep the materials in the cylinder for a desired time, resulting in that the dryer would discharge the materials insufficiently treated. Besides, the dryer has another disadvantage that the outlet partition prevents lumps in the materials from discharging to the outlet box, because the radial width or threshold of the outlet partition is too high for the lumps to get over the outlet partition. The dryer has the radial pipes extending near to the surface or into the inside of the flow of materials to inject hot air to the materials from the outer ends of the pipes. However, it is not easy to always provide the radial pipes with outer ends thereof disposed at optimum positions to blow the hot air to the flow of materials. The reason for this is that the radial pipes are not angularly adjustable but fixed while the flow of materials has such a surface that is partially differently inclined in response to the physical properties of the materials as well as the rotational speed of the cylinder.

The present invention is intended to solve the problems as described above. It is therefore an object of the invention is to provide an aeration-type rotary dryer having a chargeable capacity increased by the use of an inlet partition with a small central opening.

It is another object of the invention to provide an aeration rotary dryer having an exhaust to be increased without enlarging a central opening in an outlet partition.

It is a further object of the invention to provide an aeration-type rotary dryer enabling to discharge lumps contained in materials without trouble.

It is still another object of the invention to provide an aeration-type rotary dryer having an air duct composed of successively connected tubular members of which the upstream is larger in diameter than the downstream, in order to adjust an amount of air injected from radial pipes branched from each tubular member.

SUMMARY OF THE INVENTION

The present invention consists in an aeration-type rotary dryer of the type having an inlet box, an outlet box, an cylinder rotatably and air-tightly fitted at opposite ends thereof in the inlet and outlet boxes, means for rotating the cylinder, material-feeding means provided in the inlet box, an air duct axially extending in the cylinder, a plurality of radial pipes branched from the air duct into the inside of or onto the surface of a flow formed by materials in the cylinder, exhaust means, and material-discharging means, characterize in that the air duct is composed of a plurality of longitudinally successively connected tubular members of which the outlet- sided one is larger in diameter than the inlet-sided. This results in that hot air, injected from the outer ends of the radial pipes, is rationally distributed to the materials. The air duct has a diametrically smallest tubular member passing through an inlet hollow circular partition provided at the inlet end of the cylinder, so that the inlet partition can have a central opening diametrically reduced to receive the member and a radial width increased as a threshold. This enables the cylinder to receive more materials and have a large charging capacity.

The circular opening in the inlet partition receives a chute or conveyor end of the material feeder in addition to the tubular member of the air duct. The opening may be minimized in area when the tubular member is eccentrically located in the opening in a manner that a combination of the tubular member and the chute is centrally disposed in the opening. In preference, the tubular members are connected to each other by flanges of which at least one is formed in the peripheral portion thereof with bolt holes each being peripherally elongated. The flange allows the member integral therewith to be angularly adjustably connected to the other member. This results in that the radial pipes branched from each member are adjusted to have the outer ends thereof disposed at the central portion of the flow of materials. Then, the materials are treated at the optimum drying condition.

In preference, the dryer has an outlet partition in the form of a hollow circular plate or cylinder. In the case of a dryer having a relatively large amount of exhaust air, the outlet partition is composed of a plurality of radial louvers disposed circularly at regular intervals in the inner periphery of the cylinder. The louver is axially inclined in a manner that the outer end leads the inner end in the rotary direction of the cylinder. The louvers prohibit the materials to pass axially through spaces among the louvers. The louvers force the materials back from the spaces. Accordingly, the materials leave the cylinder from the central opening in the outlet partition to the outlet box. But, air can leave the cylinder through the spaces among the louvers to the outlet box. Therefore, the dryer can exhaust a relatively large amount of air through the outlet partition. This results to that the dryer discharge a desired amount of air through the outlet partition of which the central opening is mostly occupied by the diametrically large tubular member of the air duct.

In the case that the materials contain lumps, spoon-like lifters are provided on the inner circumference of the cylinder in front of the outlet partition. The lifter scoops the lumps in the underside to drop the same in the upper side upon rotation of the cylinder. At least a chute is also provided in the outlet box or on the air duct to receive the lumps from the lifters and discharge the lumps to the outlet box.

BEST MODE CARRYING OUT THE INVENTION

The present invention is explained in detail with reference to the accompanying drawings.

Figure 1:
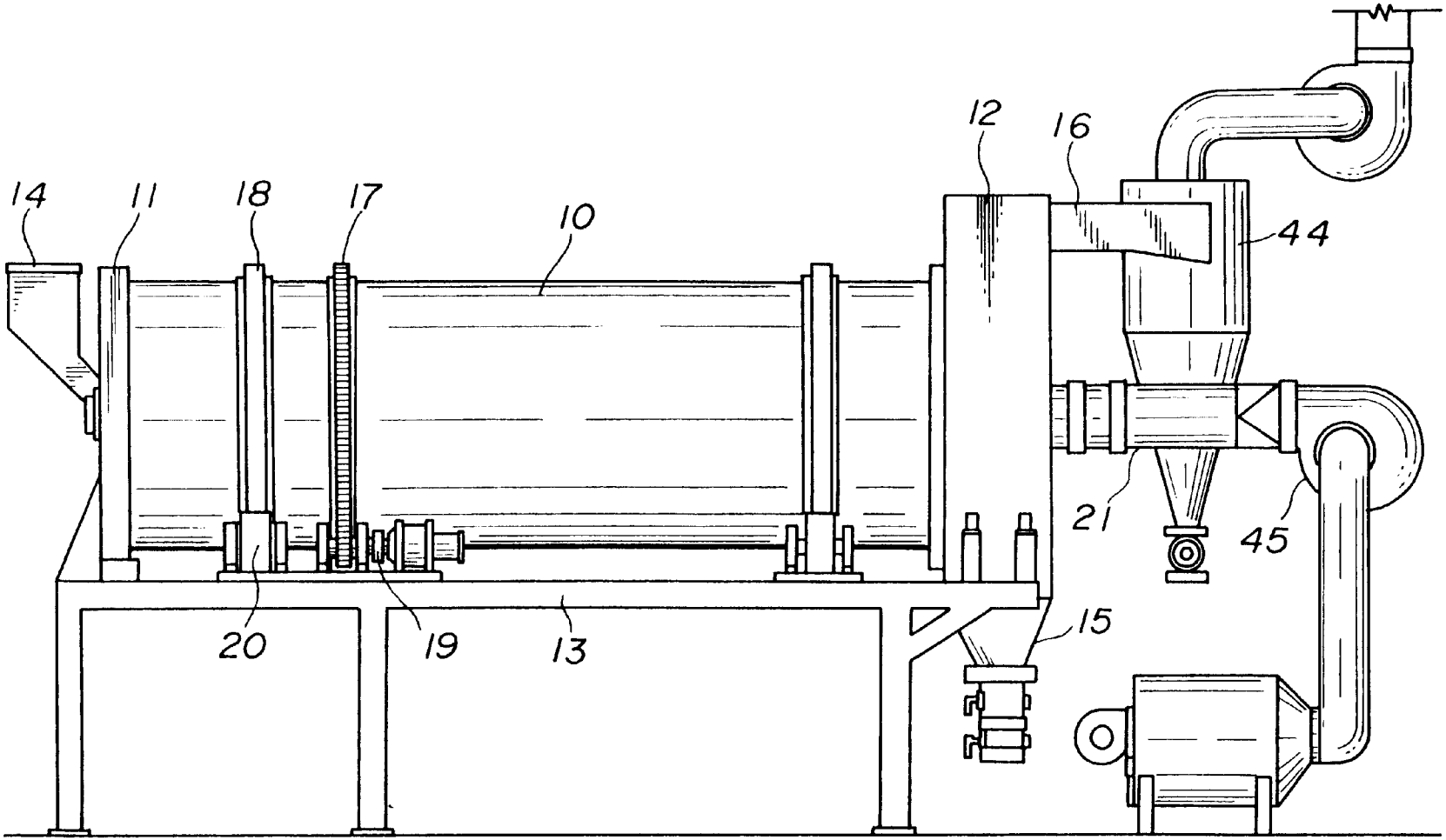
FIG. 1 is a side elevation illustrating an outline of the aeration-type rotary dryer according to the invention.

As seen in FIG. 1 in which is shown an external appearance of the aeration-type rotary dryer of the invention, a cylinder 10 has opposite ends rotatably, air-tightly fitted in inlet and outlet boxes 11, 12, respectively, which are mounted on a common base 13 or individual bases. The inlet box 11 is provided with a material-feeder 14. The outlet box 12 is equipped with a discharge port 15 and an exhaust port 16. The exhaust port 16 extends to a dust collector 44. The cylinder 10 is provided on its outer surface with a girth gear 17 and two tires 18. The gear 17 is engaged with a gear of a driving assembly 19 disposed on the base 13. The tires 18 are rotatably supported by bottom rollers 20 disposed on the base 13. The cylinder 10 is supported by the bottom rollers 20 and rotated by the driving assembly 19. An air duct 21, initiating from a fan 45, enters the outlet box 12 at the backside thereof. The air duct extends axially through the cylinder 10 from the outlet box 12 to the inlet box 11. In the case of a heating-drying process, a heater is provided in the fan 45. But, in the case of a cooling-drying process, the fan generally has no heater.

Figure 2:
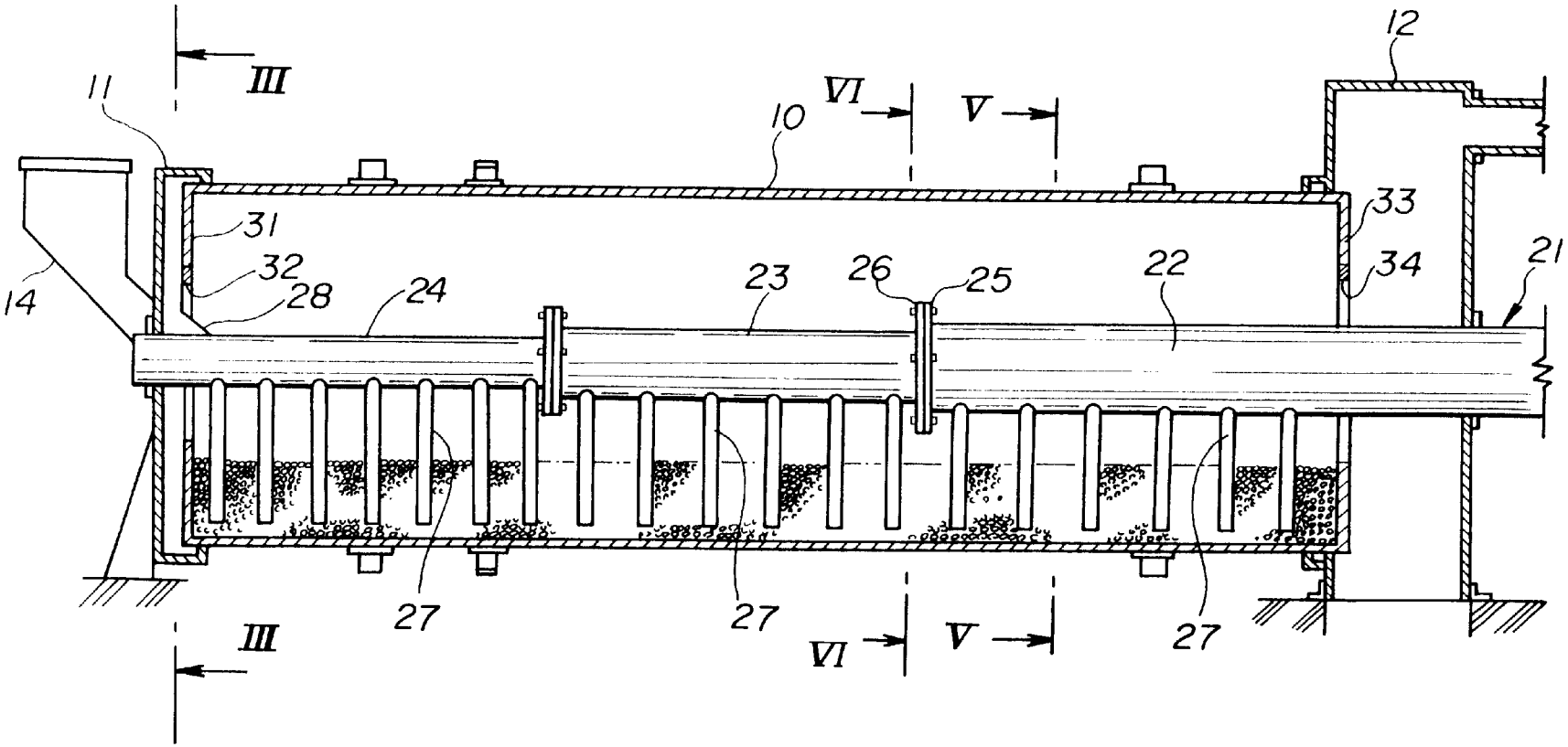
FIG. 2 is a side cross-section of the relevant portion of the dryer of FIG. 1.

As seen in FIG. 2, the air duct 21 consists of a plurality of longitudinally, successively connected tubular duct members 22, 23, 24 each having a different diameter. One member nearer to the inlet box is smaller in diameter than another. Then, one member nearer to the outlet box is larger in diameter than another. The most inlet-sided member 24 located in the inlet box 11 has the smallest diameter, while the most outlet-sided member 22 located in the outlet box 12 has the largest diameter. The duct members 22, 23, 24 are usually connected to each other by the respective flanges 25, 26. Sometimes, the duct members are connected to each other by welding. A plurality of radial pipes 27 branch off from the respective tubular members 22, 23, 24. Every radial pipe 27 extends downward onto or into a layer formed by materials in the underside of the inner surface of the cylinder 10. Each radial pipe 27 has an open apex located on the surface of or in the inside of the layer of material. The inlet partition 31 of the cylinder 10 has a circular opening 32 to receive a chute 28 or a conveyor of the material-feeder 14 together with the most inlet-sided member 24 of the smallest diameter. The outlet partition 33 of the cylinder 10 has a circular opening 34 to receive the most outlet-sided member 22 which has the largest diameter.

Figure 3:
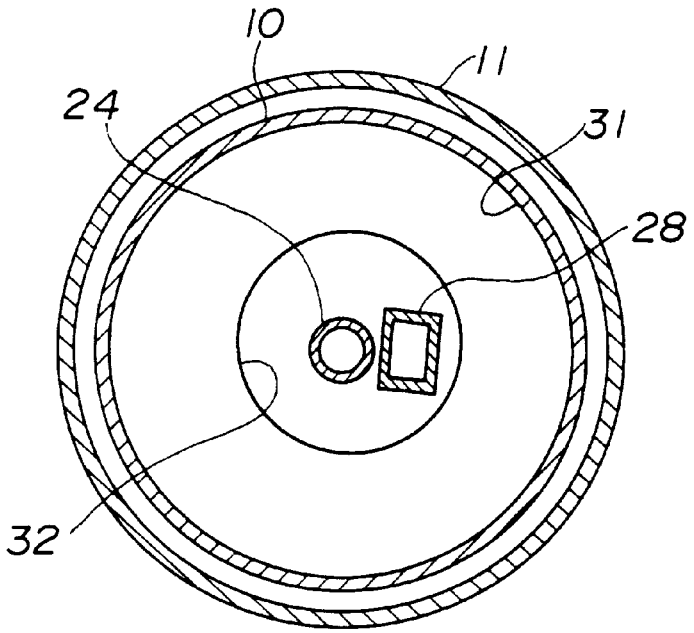
FIG. 3 is a fragmentary view taken in the direction of the arrows along the line III—III of FIG. 2.

As seen in FIG. 3, the most inlet-sided member 24 is diametrically much smaller than the conventional one, with the result that the inlet partition 31 may have the central opening 32 diametrically reduced so as to increase the radial width or height of inlet threshold. This offers an advantage that, when the dryer has the cylinder 10 and the chute 28 or conveyor similar in size to those of the conventional one, the smaller central opening 32 in the inlet partition 31 will prevent an overflow of the materials from the cylinder to the inlet box.

Figure 4:
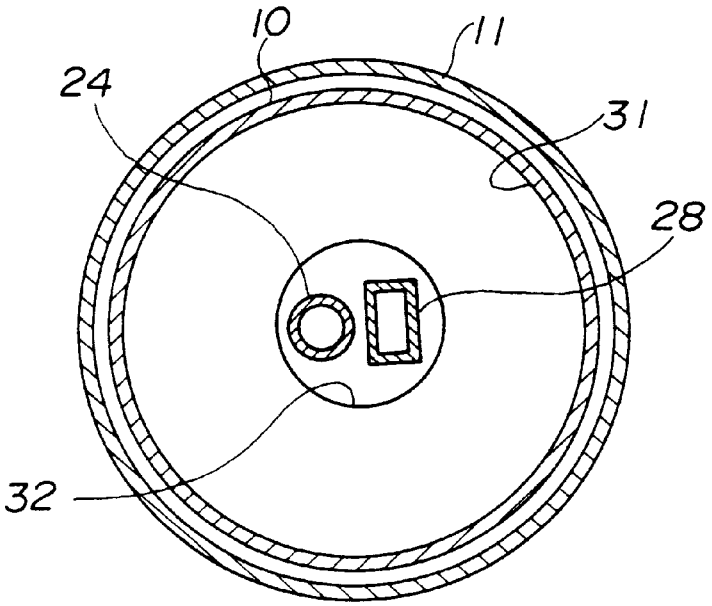
FIG. 4 is a view similar to FIG. 3, of another embodiment.

As seen in FIG. 4, when the most inlet-sided member 24 is eccentrically disposed in the central opening 32 in a manner that a combination of the member 24 and the chute 28 of the material-feeder is centrally disposed in the central opening 32, the inlet partition 31 may have the minimum central opening 32 and the maximum height of inlet threshold with the result that the materials will be unable to overflow through the inlet partition to the inlet box 11.

Figure 5:
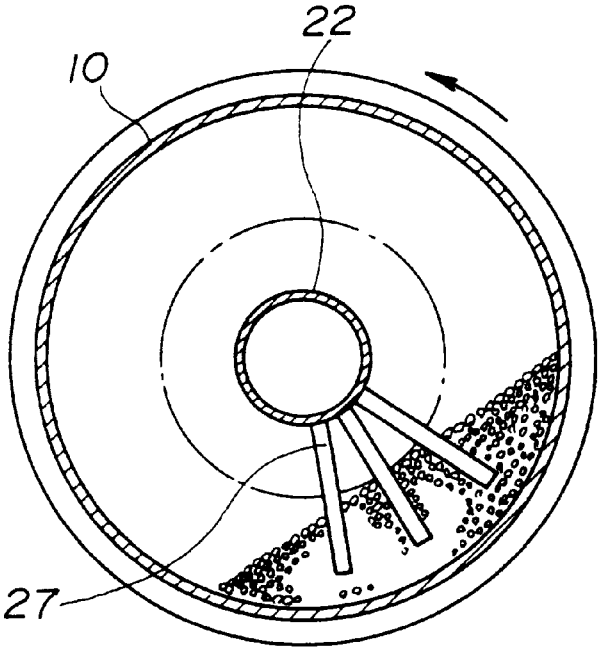
FIG. 5 is a fragmentary view taken in the direction of arrows along the line V—V of FIG. 2.

As seen in FIG. 5, the radial pipes 27 are branched in the different radial directions from the tubular member 22. The reason for this is that the materials are effectively treated in the cylinder. When the cylinder 10 rotates in the direction as shown by an arrow, the materials form a flow of which the surface makes an angle of inclination to the level. The angle of inclination depends on a friction between the materials and the inner surface of the cylinder, so that it changes as the materials advance or become dry. For example, the angle is somewhat steep at first when the materials are not dried but almost level at last when the materials are dried. The radial pipes 27 have the radial directions thereof individually adjusted in a manner that the materials are uniformly in contact with hot air injected from the radial pipes 27.

Figure 6:
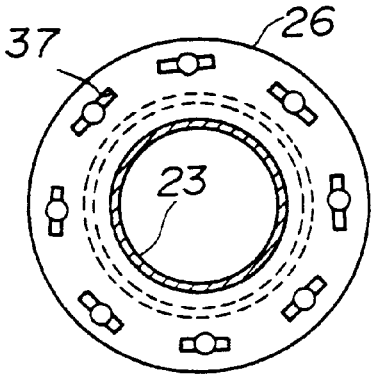
FIG. 6 is a fragmentary view taken in the direction of arrows along the line VI—VI of FIG. 2.

As seen in FIG. 6, the tubular member 23 may be provided with the flange 26, which is formed in its peripheral portion with a plurality of bolt holes 37. Each bolt hole 37 is peripherally elongated so that the member 23 is angularly, adjustably fixed to the other member. This allows each member to have the radial pipes thereof adjusted at the optimum radial direction to the flow of materials of which the surface changes as the materials advance in the cylinder.

Figure 7:
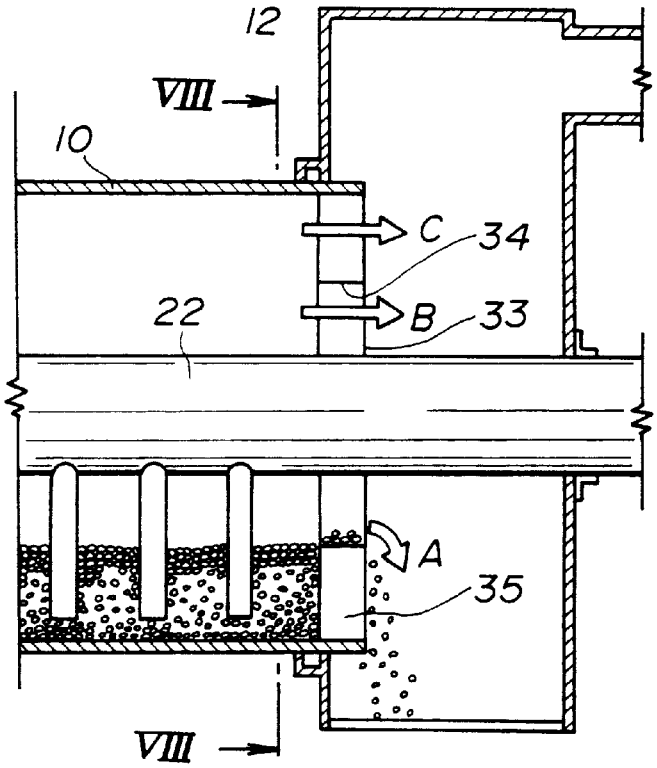
FIG. 7 is a side cross-section illustrating an outlet portion of a further embodiment.
Figure 8:
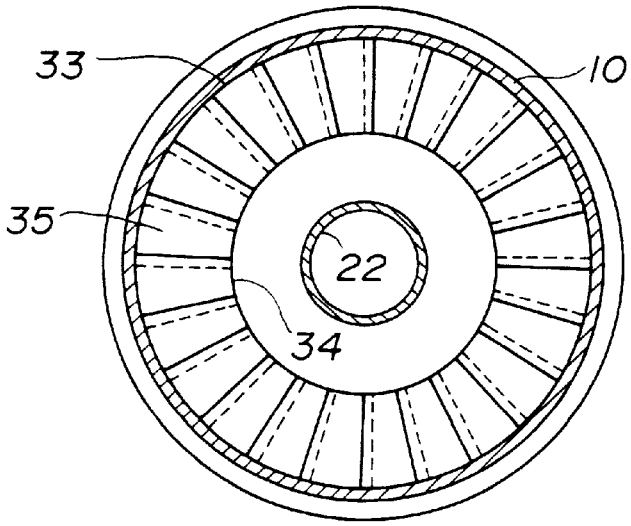
FIG. 8 is a fragmentary view taken in the direction of arrows along the line VIII—VIII of FIG. 7.

As seen in FIGS. 7 and 8, the cylinder 10 may have the outlet partition 33 formed with a plurality of louvers 35 which are disposed circularly at regular intervals. Each louver 35 is inclined to the axial direction in a manner that its outer end leads toward the rotational direction of the cylinder, so that the materials between two adjacent louvers 35 are forced back to the inside of the cylinder. Then, the materials can not leave the cylinder through a space between two adjacent louvers 35. As shown by an arrow A of FIG. 7, the materials leave the cylinder 10 to the outlet box 12 through the central opening 34 over the louvers 35 in the underside of the outlet partition 33. But, as shown by arrows B and C, air leaves the cylinder freely both through the central opening 34 and through the space between the adjacent louvers 35. This means that the louvered partition 33 acts as a threshold to the materials and as an exhaust port to air. Therefore, the dryer can exhaust a large amount of air even if the diametrically large member 22 passes through the central opening 34.

Figure 9:
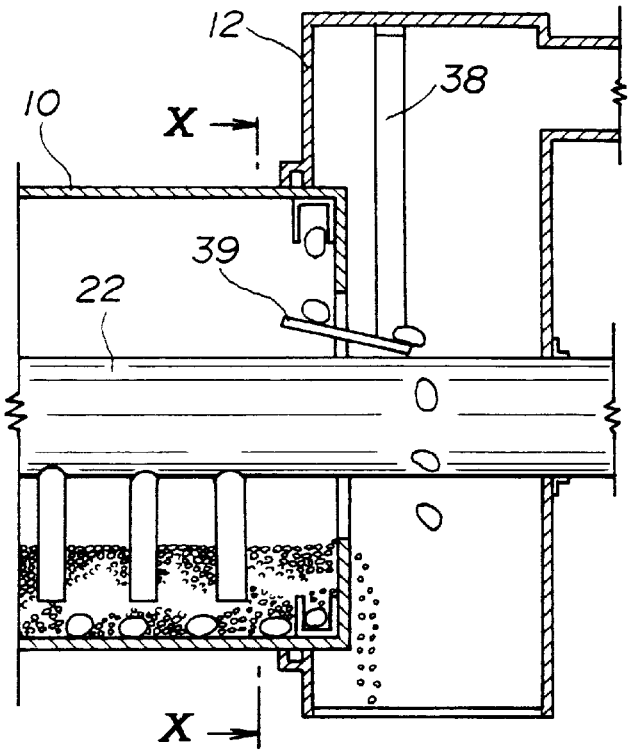
FIG. 9 is a view similar to FIG. 6, of still another embodiment.
Figure 10:
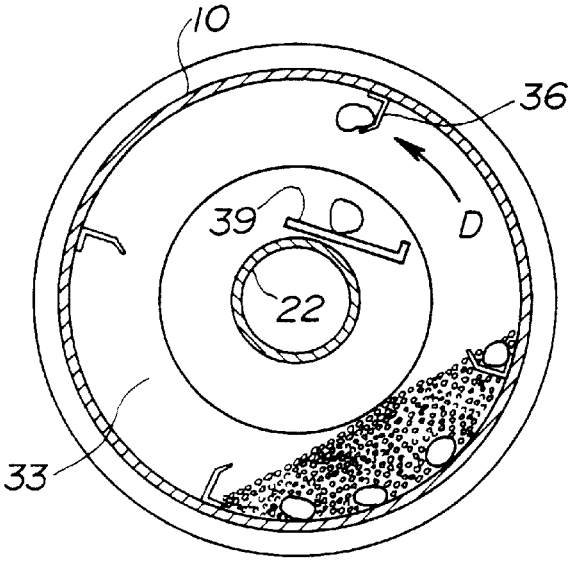
FIG. 10 is a fragmentary view taken in the direction of arrows along the line X—X of FIG. 9.

As seen in FIGS. 9 and 10, the dryer is available for drying the materials which contain such lumps that are impossible to pass over the outlet partition 33 of the cylinder 10. The dryer is provided in front of the outlet partition 33 on the inner surface of the cylinder 10 with a plurality of spoon-like or dustpan-like lifters 36 and an outlet chute 39 extending slant downward from the outlet end portion of the cylinder to the outlet box 12. A bracket 38 is fixed to the outlet chute 39 or the duct to support the outlet chute 39. As the cylinder 10 turns in the direction as shown by an arrow D, the lifters 36 rotate from bottom to top and vice versa. The lifter 36 picks up the lumps from the flow of the materials in front of the outlet partition 33 when it situates at the bottom position. Thereafter, the lifter 36 discharges the lumps onto the outlet chute 39 when it situates at the top position. Then, the lumps slide down on the outlet chute 39 to the outlet box 12. Thus, the dryer can discharge the materials, even if contain lumps, without trouble.

Figure 11:
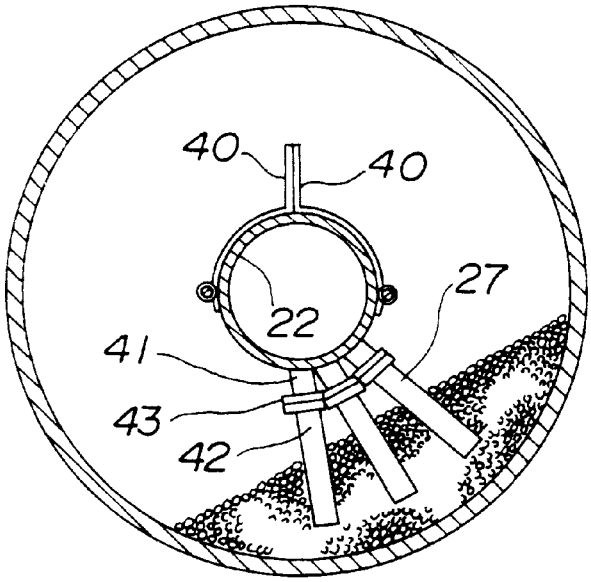
FIG. 11 is a cross-section of the cylinder of a still further embodiment.
Figure 12:
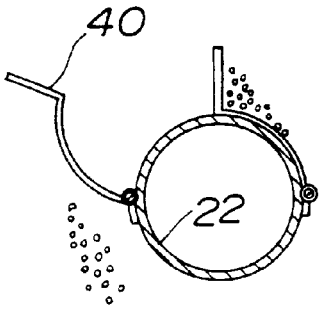
FIG. 12 is a cross-section illustrating covers of FIG. 11.

As seen in FIG. 11, the dryer may be provided with a cover 40 hinged to the member 22 for protecting the upper side of the member 22 from dust. When the cover 40 is turned over, the dust accumulated on the cover is shaken off as seen in FIG. 12. The radial pipe 27 has a root portion 41 and an apex portion 42 connected by coupling 43. This permits the apex portion 42 to be easily exchanged.

INDUSTRIAL APPLICABILITY

The aeration-type rotary dryer of the invention is capable of drying a large amount of materials as compared with the conventional non-aeration type rotary dryer having the same volume. It is more than double in drying capacity and higher in heat-efficiency than the conventional non-aeration type dryer. Therefore, it is applicable for heating, drying and cooling chemicals such as fertilizers and resins, mineral products such as coal, cokes, sand, ores and slag, and agricultural products such as grain and sugar.

I claim:

1. An aeration-type rotary dryer comprising an inlet box, an outlet box, a rotary cylinder having inlet-side and outlet-side ends thereof air-tightly and rotatably fitted in said inlet and outlet boxes, a material-feeding device attached to said inlet box, outlet and exhaust ports disposed respectively in said outlet box, an air duct axially extending through said cylinder from said outlet box to said inlet box, a plurality of radial pipes branched slant downward from said air duct and having outer ends thereof located near to an inner surface of said cylinder, an inlet partition formed with a central circular opening and fixed to the inner surface of said cylinder at the inlet-side end thereof, an outlet partition formed with a circular opening and fixed to the inner surface of said cylinder at the outlet-side end thereof, characterized in that said air duct is composed of a plurality of longitudinally, successively connected tubular members each nearer to said inlet box being smaller in diameter than the other nearer to said outlet box.

2. The dryer of claim 1, wherein said members are connected to each other by flanges each being formed in a peripheral portion thereof with a plurality of peripherally elongated bolt bores.

3. The dryer of claim 1, wherein one of said members nearest to said inlet box is eccentrically located within said circular opening in said inlet partition so as to minimize said opening.

4. The dryer of claim 1, wherein said radial pipes extend in different radial directions from said air duct.

5. The dryer of claim 1, wherein said radial pipe is composed of a root portion connected to said tubular member and a tip portion connected to said root portion by a joint.

6. The dryer of claim 1, wherein a cover is hinged to at least one of said tubular members protecting an upper half thereof.

7. The dryer of claim 1, wherein said outlet partition is compose of a plurality of louvers annularly at regular intervals disposed on the inner peripheral surface of said cylinder, said louvers being axially inclined so as to have an outer end thereof advanced from an inner end thereof toward the rotational direction of said cylinder, whereby materials are prevented from passing through a space between two adjacent louvers of said plurality of louvers to said outlet box.

8. The dryer of claim 1, wherein said cylinder is provided on an inner peripheral surface thereof in front of said outlet partition with a plurality of one of spoon shaped and box shaped flights and a chute supported by said air duct, whereby said materials are picked up by said flights in a bottom side of said cylinder and dropped down to bald outlet box through said chute.

9. The dryer of claim 1, wherein said cylinder is provided on an inner peripheral surface thereof in front of said outlet partition with a plurality of one of spoon shaped and box shaped flights and a chute supported by said outlet box, whereby said materials are picked up by said flights in a bottom side of said cylinder and dropped down to said outlet box through said chute.

* * * * *